United States Patent [19]

Magourik

[11] Patent Number: 4,817,541

[45] Date of Patent: Apr. 4, 1989

[54] KNIFE HOLDER CLAMP APPARATUS FOR CUT PILE TUFTING MACHINE

[75] Inventor: Ray O. V. Magourik, Chattanooga, Tenn.

[73] Assignee: Tuftco Corporation, Chattanooga, Tenn.

[21] Appl. No.: 177,166

[22] Filed: Apr. 4, 1988

[51] Int. Cl.[4] ..... D05C 15/24

[52] U.S. Cl. ..... 112/80.6

[58] Field of Search ..... 112/80.6, 80.5

[56] References Cited

U.S. PATENT DOCUMENTS 3,757,709 9/1973 Cobble ..... 112/80.6

4,445,446 5/1984 Beasley ..... 112/80.6

*Primary Examiner*—Ronald Feldbaum

*Attorney, Agent, or Firm*—Harrington A. Lackey

[57] ABSTRACT

A knife holder apparatus for a cut pile tufting machine including a plurality of knife blocks, each knife block being fixed to a depending staff having an upright elongated channel, and a transverse knife bar having forwardly projecting, transversely spaced angular rib members for receiving the channels of the corresponding staffs. A transverse clamp pin bridging the channel of each staff is adapted to be received in a transverse clamping slot formed at a rearward inclination in each rib member and to be forced upward against the rearwardly inclined upper wall of the transverse slot by a set screw projecting upwardly into the slot for clamping the knife block in a predetermined position upon the knife bar to hold the knives in their tensioned positions against their corresponding looper hooks.

8 Claims, 2 Drawing Sheets

KNIFE HOLDER CLAMP APPARATUS FOR CUT PILE TUFTING MACHINE

BACKGROUND OF THE INVENTION

This invention relates to a cutting apparatus for a multiple needle cut pile tufting machine, and more particularly to a knife holder apparatus for a cut pile tufting machine.

Conventionally, the knives utilized in multiple-needle cut pile tufting machines for cooperation with looper hooks to form cut pile tufts have been supported in individual knife blocks which includes tracks or guideways for engaging the opposite edges of each knife. Each knife block is provided with a rearward projecting cylindrical stud or rod which is adapted to be rotatably adjustably received in a corresponding hole in a knife bar. This structure permits the knives to be set at the desired tension angles relative to the looper hooks. The stud holes in the knife bars are disposed at angles to the transverse dimension of the knife bar, which are equal to the pitch angle of the knife blades relative to the looper hooks. Each knife is secured in its knife block by a threaded set screw, threadedly received within the knife block for movement toward and away from direct engagement with the edge of each knife.

Other prior art knife holders include knife blocks capable of supporting multiple numbers of knives, such as two, three, four or eight knives each. Furthermore, in some knife blocks, one set screw may be utilized to secure two knife blades, instead of one.

Examples of typical knife holders for multiple needle cut pile tufting machines are shown in the following U.S. Pat. Nos.: 3,277,852, Card, Oct. 11, 1966; 4,003,321, Card, Jan. 18, 1977; and 4,067,270, Short, Jan. 10, 1978.

Because of the continuous vibration of a multiple-needle tufting machine during its operation and the tension between the knives and their corresponding looper hooks, considerable stress is exerted upon the rearward projecting cylindrical studs or rods in the typical knife blocks, causing the knife blocks to rotate, and in turn causing the knives to loose their proper tension angles with their cooperating looper hooks.

Several attempts have been made to provide knife holder apparatus which will rigidly mount the knife blocks relative to the knife bar without depending entirely upon the rearward projecting studs from the knife blocks received within corresponding holes in the knife bar.

In the Cobble U.S. Pat. No. 3,757,709, issued Sept. 11, 1973, although the rearward projecting stud and its cooperating hole are retained, nevertheless, angular channels or guideways are formed in the front face of the knife bar for receiving the back faces of the corresponding knife bars.

T-shaped slots, similar to the vertically disposed angular channels of the above Cobble U.S. Pat. No. 3,757,709 are incorporated in the face of the knife bar of the Card et al patents, U.S. Pat. Nos. 4,608,934, issued Sept. 2, 1986, and 4,669,171, issued June 2, 1987, in order to accommodate an elongated bracket fixed to the knife holder and provided with laterally projecting lugs for slidable reception within the corresponding slots of the knife bar. In the Card et al patents, U.S. Pat. Nos. 4,608,934, and 4,669,171, the rearward projecting stud is eliminated. However, the vertical slidable bracket is retained in position within its corresponding T-slot by detent set screws 41, 141, and 241. In the Card et al patents, the bracket is slidably moved linearly upward along its corresponding slot. As the knives approach their looper hooks, they are flexed by a knife tension tool until the knives engage their corresponding looper hooks. The upward movement of the bracket and knife holder is arrested when the blades are in their operative position cooperating with their corresponding looper hooks, by an arresting pin 38 or arresting set screw 141 or 241. The set screws 41 rely upon their capability of engaging the back surface 33 of the T-slot when tightened, in order to lock the corresponding bracket and its knife holder in its operative position relative to the knife bar, whereas the arresting screws 141 and 241 rely upon their heads bearing against the front surfaces of the brackets adjacent their corresponding slots 140 and 240.

In the co-pending application Ser. No. 145,108, filed, Jan. 19, 1988, of Ray O. V. Magourik, for a "Knife Holder Apparatus for Cut Pile Tufting Machine", each knife block is provided with a depending mast which is slidably mounted within a corresponding slot in the knife bar. A wedge clamp member is adapted to clamp or lock the knife bar carrying a plurality of knives in an operative position relative to the knife bar in which the knives cooperatively engage their corresponding looper hooks. The upper end of each upright slot is enlarged to receive a wedge member and an elongated threaded bolt is inserted upwardly through the knife bar and the slot clamping the wedge member against the mast or staff of the knife block.

However, in both the Card et al patents, U.S. Pat. Nos. 4,608,934, and 4,669,171, and the wedge clamp apparatus of the above pending application of Magourik, the brackets, masts or staffs must first be inserted upward into engagement with their corresponding slots where they are confined in a linear path as the knife blocks are moved upwardly. However, before the knives can be introduced between their corresponding loopers, the knives must be tensioned or twisted, preferably by a tensioning tool, such as that disclosed in FIGS. 13 and 14 of the Card et al U.S. Pat. No. 4,608,934 before the knives can be finally moved upward into their final cooperating positions with their corresponding looper hooks.

Tuftco Corporation, the Assignee of this application, has produced a knife holder module similar to the one disclosed in their prior U.S. Pat. No. 4,445,446, in which an upright key-way is formed in the back of each knife block to register and receive a pin projecting forward from the front face of the knife bar. Moreover, a transverse key or tang projects upward from the transverse tongue for reception within a corresponding key-way in the upper surface of the transverse groove which receives the tongue.

SUMMARY OF THE INVENTION

It is therefore an object of this invention to provide in a multiple-needle cut pile tufting machine, a cutting apparatus comprising a plurality of knife holder modules, each knife holder module including a depending staff having an upright rearward opening channel adapted to fit over a correspondingly shaped upright rib member projecting forward from the knife bar, to predispose the staffs and the knives at their predetermined compound tension and pitch angles.

Because of the channel shape of each staff and the corresponding shape of each projecting rib member, the staff may be fitted over its corresponding rib member by moving it rearwardly toward the knife bar. The upper edges of the knives of each knife holder module are first introduced between and against their corresponding loopers before the channel-shaped staff is thrust rearward over its corresponding rib member. Accordingly, the staff is not confined to an upward linear movement which prevents pre-tensioning of the knives without a special tensioning tool.

A further object of this invention to provide a unique clamping device for holding the staff upon its rib member after it is fitted over its corresponding rib member. The clamping device includes preferably a transverse clamp pin bridging the channel of the staff and a transverse clamping slot formed in the rib and angling upward and rearward for receiving the clamp pin in a rearward and upward motion to bind the staff against the rib member in a fixed position holding the knives at a predetermined compound angle relative to their corresponding looper hooks. A threaded detent member, such as a set screw, is inserted through the bottom of the knife bar to hold the clamp pin against the depending upper wall of the clamping slot.

DESCRIPTION OF THE PREFERRED EMBODIMENT

Figure 1:
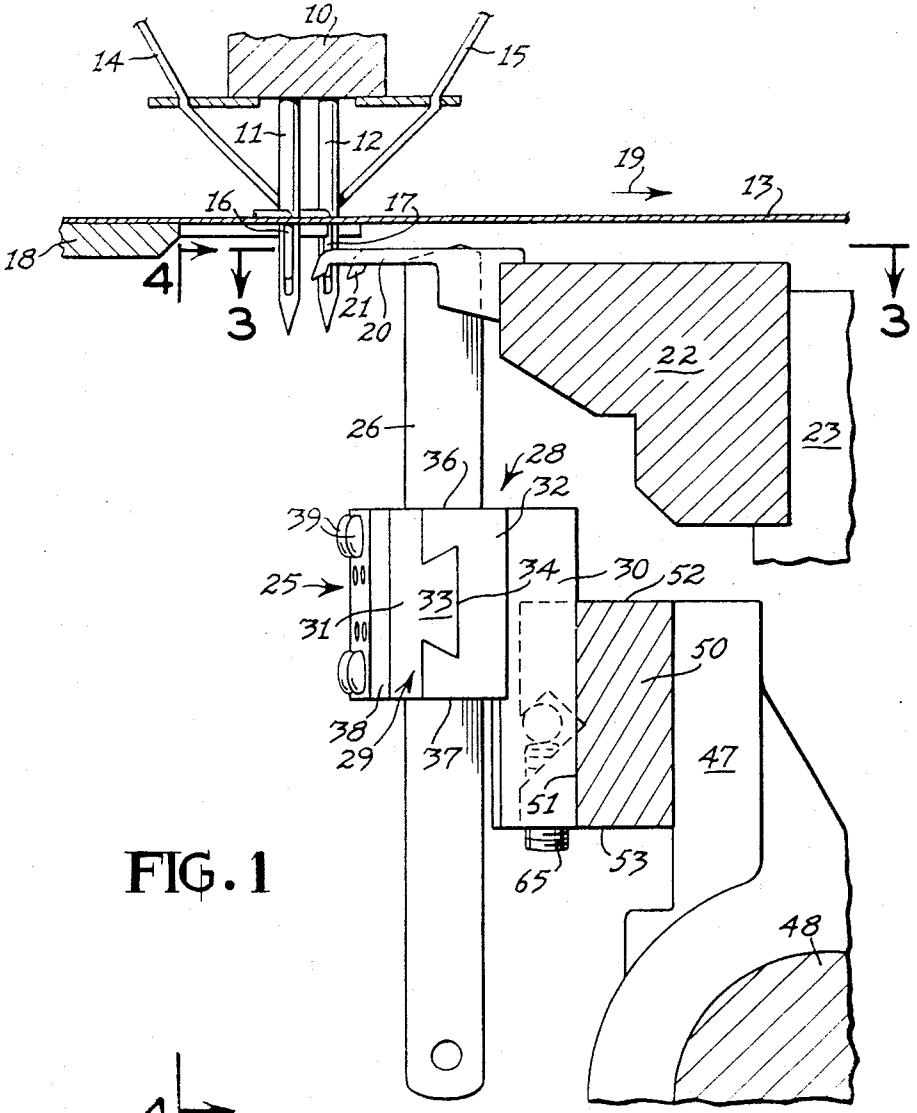
FIG. 1 is a fragmentary sectional elevation of a portion of a staggered needle cut pile tufting machine, illustrating the knife holder apparatus made in accordance with this invention in clamped position upon the knife bar, and illustrating the needles in loop-forming positions penetrating the base fabric and the knives and looper hooks in their cutting positions.

Referring now to the drawings in more detail, FIG. 1 discloses a transverse needle bar 10 in a conventional multineedle tufting machine supporting a row of uniformly, transversely spaced, staggered front and rear needles 11 and 12 extending transversely of the machine. The needle bar 10 is vertically reciprocated by conventional means, not shown, to cause the needles 11 and 12 to move between an upper position above the base fabric 13 and a lower position (FIG. 1) penetrating the base fabric 13, so that the needles 11 and 12 will carry yarns 14 and 15, respectively, through the base fabric 13 to form loops 16 and 17 therein. The base fabric 13 is supported upon a needle plate 18 for movement, by means not shown, in the direction of the arrow 19 of FIG. 1, that is, longitudinally in a feeding direction from front-to-rear through the machine.

Cooperating with each needle 11 and 12 is a corresponding cut pile looper hook 20 and 21. A plurality of the looper hooks 20 and 21 are carried in the transverse hook bar 22 fixed upon a plurality of transversely spaced brackets 23, which are in turn journaled upon a rock shaft, not shown, for reciprocal movement of the hook bar 22 in synchronism with the reciprocal movement of the needles 11 and 12, in a conventional manner.

The cutting apparatus 25 made in accordance with this invention includes a plurality of knives 26, each knife 26 being adapted to cooperate with a corresponding looper hook 20 or 21 for cutting the yarn loops 16 and 17 on the hooks to form cut pile tufts.

The cutting apparatus or knife holder apparatus 25 includes a knife holder module 28 comprising a knife block member 29 and a supporting staff 30. The knife block member 29 is preferably constructed in the same manner as the knife block member in U.S. Pat. No. 4,445,446 incorporating a front section 31 and a rear section 32 secured together by a cooperating transverse tongue 33 and a transverse cooperating groove 34. The knife block member 29 is solid throughout, except for the transversely spaced elongated upright, or vertically disposed, knife slots 35. Each knife slot 35 has a widthwise dimension only slightly greater than the width of each corresponding knife blade. The thickness of each knife slot 35 is substantially equal to the thickness of each corresponding knife or knife blade 26, so that each knife 26 has a snug sliding fit, to permit each knife 26 to be vertically moved by hand relative to the corresponding knife slot 35. Thus, each knife 26 is completely surrounded by, and substantially engages solid material in the block member 29, so that each knife 26 has firm, solid, reinforced support throughout the vertical extent of the knife portion within its corresponding knife slot 35.

The knife slots 35 extend parallel to each other and substantially vertically throughout the full height of the block member 29 and open through the top surface 36 and the bottom surface 37 of the block member 29.

As described in the prior Beasley U.S. Pat. No. 4,445,446, the face surface of the front block section 31 is covered by a cap plate 38 secured by the bolts 39. Formed through the cap plate 38 are also a plurality of set screws or clamp elements 40 aligned with the front edges of each pair of knives 26 received in the knife slots 35 for retention of the knives 26 in place within each knife block member 29.

The elongated staff 30 in each knife holder module 28 has a height substantially greater than the height of its corresponding knife block member 29 and has a channel-shaped cross section defined by a web portion 42 and a pair of rearward projecting parallel side flanges 43 and 44. The opposed side flanges 43 and 44 have opposed parallel inner planar surfaces 45, which are uniformly spaced throughout the length of the staff 30.

Spanning the side flanges 33 and 34 of each staff 30 is an elongated transversely disposed clamp element or clamp pin 46.

Mounted upon a plurality of knife brackets 47 (FIG. 1) for reciprocable motion upon a knife shaft 48 in synchronous relation with the movement of the hook bar 22 and the needle bar 10, is an elongated transverse knife bar 50, having a front face 51, a top face 52, and a bottom face 53.

Projecting forward from the front face 51 of the knife bar 50 are a plurality of rib members 55. Each rib member 55 extends in a generally upright direction the full height of the knife bar 50 and includes a front face 56, and a pair of opposed parallel planar side faces 57 and 58. The spacing between the opposed side faces 57 and 58 is substantially equal to, or more accurately, slightly less than, the transverse distance between the opposing inner surfaces 45 of the side flanges 43 and 44 of each staff 30, so that each staff 30 may readily slip-fit over each rib member 55 in longitudinal alignment.

Moreover, as disclosed in the drawings, each rib member 55 is disposed at an angle to the vertical, or to the longitudinal axis of the transverse knife bar 50, equal to the desired tension angle in the knives 26, relative to their looper hooks 20 and 21. Furthermore, each of the rib members 55 is disposed on the face 51 of its corresponding knife bar 50 at a slight angle in a front-to-rear direction relative to the front-to-rear longitudinal dimension of the knife bar 50, corresponding to the pitch angle of each knife 26 relative to its looper hook 20 and 21. Thus, each rib member 55 is disposed at a compound angle corresponding to the tension angle and the pitch angle of the knives 26. Thus, when a channel-shaped staff 30 is slip-fitted over a corresponding rib member 55, the staff 30 is automatically located at the same compound angle defined by the rib member 55.

Figure 5:
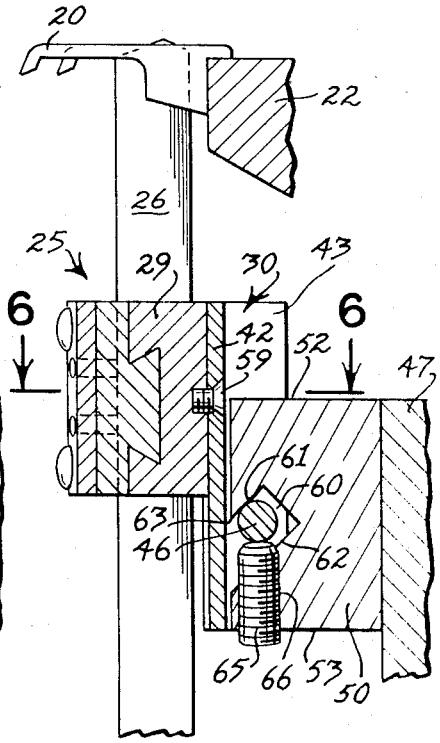
FIG. 5 is a fragmentary sectional elevation taken along the line 5—5 of FIG. 4.
Figure 7:
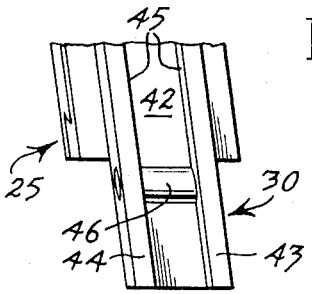
FIG. 7 is a fragmentary rear elevational view of the lower portion of a knife holder module made in accordance with this invention.

As disclosed in the drawings, and particularly in FIG. 5, the upper end portion of the staff 30 is fixedly secured flush against the back surface of the knife block member 29 by one or more screws 59 projecting through the web portion 42 of the corresponding staff 30.

As illustrated in the drawings, each staff 30 projects downward below the bottom surface of each knife block member 29.

Formed in each rib member 55 is a transverse slot or clamping slot 60 having an upper wall portion 61 and a lower wall portion 62.

As illustrated in the drawings, the slot 60 is formed as a straight transverse slot across each rib member 55, but the upper wall portion 61 angles upward and rearward into the rib member 55 to form a front depending catch element 63. As illustrated in the drawings, the slot 60 is formed rearwardly on an incline of approximately 45 deg. However, the angle of the slot 60 is not material, so long as the front portion of the upper wall 61 or catch element 63 depends in front of the transverse clamp pin 46, when the clamp pin 46 is inserted rearward into its corresponding slot 60 in its clamping position.

The height of the slot 60 is slightly greater than the height or diameter of the clamp pin 46 to facilitate passage of the pin 46 into the slot 60, particularly while the clamping pin 46 and the entire knife holder module 28 are under the cocking or twisting pressure exerted upon the knives 26 by their corresponding looper hooks 20 and 21 when the channel-shaped staff 30 is fitted over its corresponding rib member 55 predisposed at the predetermined compound angle, tension and pitch angle.

After the pin 46 is fully inserted into its corresponding clamping slot 60, a detent member or set screw 65 threaded through a corresponding threaded hole 66 extending vertically through the bottom surface 53 of the knife bar 50 and through the bottom wall portion 62 of the clamping slot 60, is turned to move upward and engage and urge upwardly the transverse clamp pin 46.

As the clamp pin 46 rises in the slot 60, it engages and is forced rearward by the upward and rearward sloping wall portion 61 of the slot 60, which, simultaneously, forces the channel-shaped staff 30 rearward toward a tight clamped position relative to the corresponding rib member 55. The higher the clamp pin 46 rises along the upper wall portion 61 of the slot 60, the greater the effective thickness of the solid material between the clamp pin 46 and the front face 56 of the rib member 55, and therefore the greater the effective strength of the catch element 63 in holding the staff 30, and therefore the knife holder module 28 against the compound twisting pressure caused by the knives 26 flexed at their compound angles.

Each of the clamping slots 60 is formed in its corresponding rib member 55 at an elevation on the rib member 55 such that when the clamp pin 46 is inserted in clamped position within the corresponding slot 60, the knives 26 will be located at the desired height to cooperate with their corresponding looper hooks 20 and 21 to form the desired cut pile tufts. The cooperating height of the cutting edges of the knives 26 relative to their corresponding hooks 20 and 21 is also determined by the height of the staff 30, the location of the transverse clamp pin 46, as well as the vertical location of the knives 26 relative to their corresponding knife block members 29.

The spacing between adjacent rib members 55 is great enough to receive a pair of adjacent side flanges 43 and 44 of the adjacent staffs 30 when the corresponding staffs 30 are fully installed or fitted over their corresponding rib members 55. The spacing between the rib members 55 is also great enough that when the knife holder modules 28 are fully assembled in their operative positions, the side surfaces of the knife block members 29 abut flush against each other, as illustrated in FIGS. 3 and 4.

Figure 3:
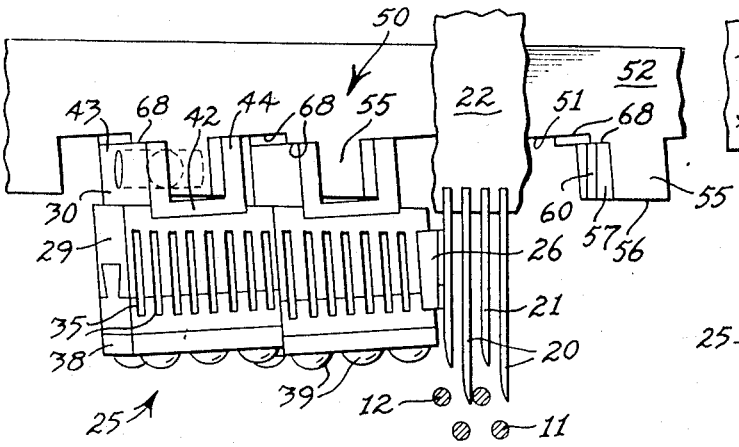
FIG. 3 is a fragmentary top plan sectional view taken along the line 3—3 of FIG. 1, with two of the knife holder modules in clamped position, and with portions of the hook bar broken away.
Figure 6:
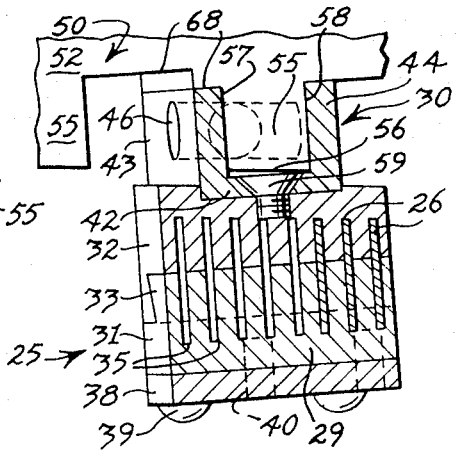
FIG. 6 is a fragmentary section taken along the line 6—6 of FIG. 5.
Figure 4:
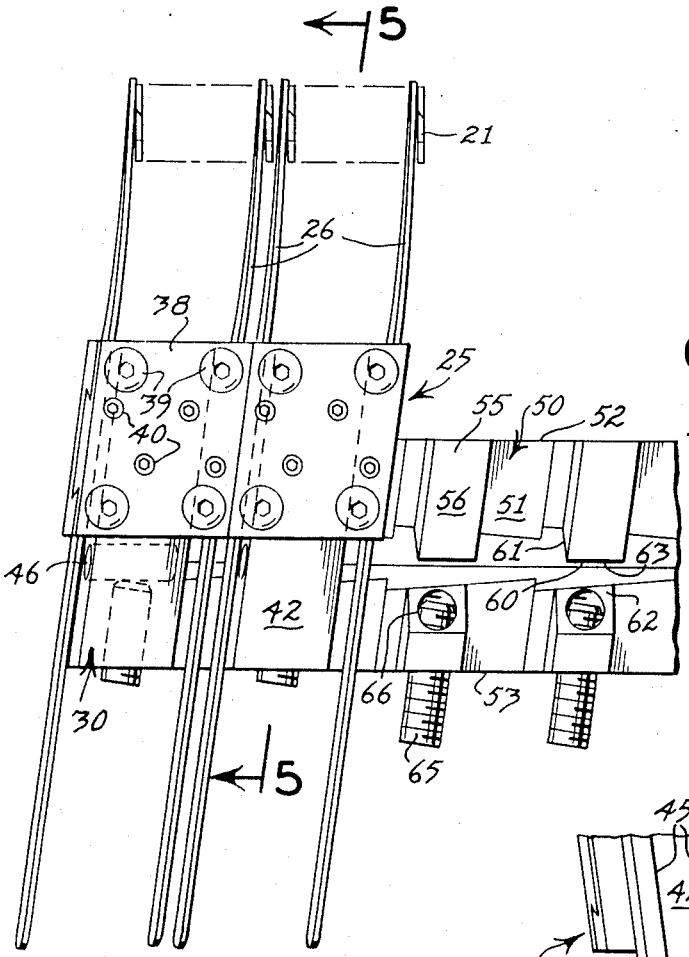
FIG. 4 is a fragmentary front elevational view taken along the line 4—4 of FIG. 1, with two of the knife holder modules mounted in clamped position upon the knife bar.

As illustrated in FIG. 3, the face surface 51 of the knife bar 50 may be formed in stepped angular ledges 68, to provide abutments for the rear edges of the side flanges 43 and 44 of each staff 30, since the staffs 30 are disposed at angles corresponding to the pitch angles of the knives.

In the operation of the cutting apparatus 25, each knife holder module 28, including the knives 26, the knife block member 29 and the staff 30, may be removed from the knife bar 50 by unthreading each set screw 65 downward through its corresponding hole 66 to release the binding engagement between the set screw 65, the clamp pin 46, and the upper wall portion 61 of the slot 60. Then, the knife block member 29 may be manually grasped, pulled downward and forward to remove the clamp pin 46 from its slot 60 and then pulled farther downward to release the knives 26 from engagement with their corresponding looper hooks 20.

If it is desired to move or replace any of the knives 20 or 21, the corresponding set screws 40 may be unscrewed to loosen the corresponding knives. The knives may then be replaced, or sharpened and re-inserted, and the set screws 40 re-tightened to lock the knives 20 and/or 21 in their respective block members 29.

Figure 2:
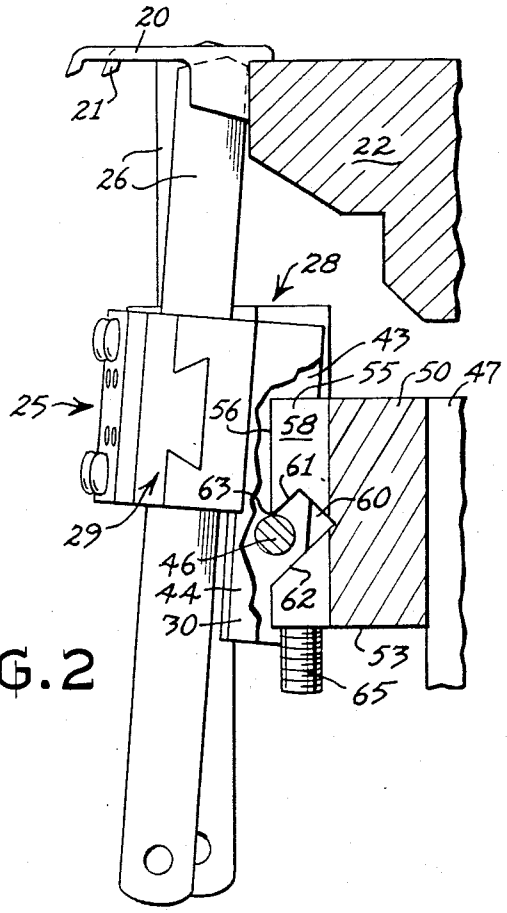
FIG. 2 is a fragmentary sectional elevation of the machine illustrated in FIG. 1, with the needle plate and needles removed, and further illustrating one of the knife holder modules in an intermediate assembly position prior to being clamped in the knife bar.

In order to reassemble the knife holder module 28 upon the hook bar 50, the reverse procedure is executed. First, the knife holder module 28 is moved upward from beneath the machine to a position in front of the knife bar 50. The top edges of the knives 26 are then inserted between and against their corresponding looper hooks 20 and 21. While the knives 26 engage their hooks 20 and 21, the knife block member 29 is rotated or twisted in order to bend or flex the knives 26, as illustrated in FIG. 4, until the clamp pin 46 registers with the front opening of its corresponding slot 60. Then, the pin 53 is pushed rearward until the pin 46 is cammed upwardly by the upwardly inclined lower wall 62 of the slot 60. The insertion of the pin 46 into the open end of the slot 60 is disclosed in FIG. 2, after the upper ends of the knives have been inserted between their corresponding looper hooks 20 and 21.

After the clamp pin 46 is fully inserted into its slot 60, as illustrated in FIGS. 1 and 5, the set screw 65 is manually turned from below the knife bar 50 to force the clamp pin 46 rearward and upward against the upper wall surface 61 of its corresponding slot 60 and in binding engagement with the depending catch element 63. As the set screw 65 is turned upward, the cutting edges of the knives 26 are forced upwardly a slight degree to finally tension the knives 26 at their proper tension angles with their corresponding loopers 20 and 21 and also in their proper cooperating positions with the looper hooks 20 for cutting the loops.

Although it is possible to utilize a tensioning tool such as that disclosed in the Card et al patent, U.S. Pat. No. 4,608,934 (FIGS. 13 and 4) in order to pre-tension the knives 26, nevertheless, pre-tensioning has to be conducted before the staff 30 is finally fitted over its corresponding rib member 55 and before the clamp pin 46 can be inserted into its corresponding opening 60. In other words, whether or not the pre-tension tool is utilized, the cutting edges of the knives 26 must first be introduced between their corresponding looper hooks 20 and 21 before the clamp pin 46 can be inserted into the clamping slot 60.

It has been found that the assembly of the knife holder modules 28 upon the knife bar 50 can be effected more quickly without the use of the tensioning tool.

The cutting apparatus 25 made in accordance with this invention facilitates accessibility to the knives 26 and knife block members 29 for inspection, repair and maintenance below the machine, and permits rapid removal or insertion of the multiple knives 26 in their operative positions upon the knife bar 50.

The cutting apparatus 25 made in accordance with this invention provides a clamping structure for firmly holding the knives 26 at their pre-determined compound cutting angles with respect to the looper hooks 20 and 21, for long periods of time during continuous operation of the tufting machine incorporating such cutting apparatus 25.

What is claimed is:

1. In a cut pile tufting machine having means for supporting a base fabric for longitudinal movement in a feeding direction through said machine, a plurality of transversely spaced reciprocal needles for introducing yarns through said base fabric to form loops, a looper hook for each needle on the opposite side of the base fabric from the needles and adapted to cooperate with a corresponding needle to seize and hold a yarn carried by the needle to form a loop, a cutting apparatus comprising:

(a) a knife holder module comprising a knife block member having front and rear portions and top and bottom portions, and an elongated staff having upper and lower portions and opposed sides, (b) a plurality of elongated knife slots extending upright through said block member, (c) a plurality of elongated knives, each knife being received in a corresponding knife slot, (d) securing means in said block member for engaging and holding each knife in said corresponding knife slot to project above said knife block member, (e) said staff being fixed to the rear portion of said knife block member, (f) an elongated knife bar mounted below said looper hooks for cooperative reciprocable movement with said looper hooks, said knife bar having a front face, a top face, and a bottom face, (g) a plurality of upright rib members projecting from said front face of said knife bar, each of said rib members being disposed at an angle to the longitudinal axis of said knife bar, said adjacent rib members being transversely spaced to define recesses between said rib members, (h) a transverse clamping slot formed in each rib member, each clamping slot having upper and lower portions and opening forward, (i) said upper portion of each clamping slot defining a depending catch element, (j) said elongated staff comprising an elongated rearward opening channel adapted to slip-fit over and receive a corresponding rib member in an operative position in which said knives project upward between corresponding looper hooks, (k) a clamp element on said staff adapted to be inserted within said clamping slot and fit behind said catch element in said operative position, and (l) detent means in the lower portion of said slot for securing said clamp element against said catch element to hold said staff upon said corresponding rib member in said operative position.

2. The invention according to claim 1 in which said detent means comprises an elongated threaded detent member threadedly received in a corresponding hole in said knife bar and adapted to project upward through the lower portion of said clamping slot for engaging and forcing upward said clamp element.

3. The invention according to claim 1 in which each said rib member is disposed at a compound angle to the longitudinal axis of said knife bar corresponding to the desired tension angle and pitch angle of each knife blade relative to its corresponding looper hook.

4. The invention according to claim 1 in which said channel has a pair of parallel rearward projecting opposed side flanges and said clamp element comprises an elongated transverse clamp pin fixed to and projecting between said side flanges the diameter of said transverse clamp pin being less than the height of said slot.

5. The invention according to claim 1 in which said transverse clamping slot is formed upward and rearward in said corresponding rib member.

6. The invention according to claim 5 in which said transverse clamping slot comprises an upper wall projecting upward and rearward at an angle to the upright axis of said rib member, the front portion of said upper wall defining said catch element.

7. The invention according to claim 6 in which said upper wall is planar.

8. The invention according to claim 1 in which each of said knife block members has a pair of parallel planar side faces, the spacing between said rib members and the dimensions of said staffs and said knife block members being such that said opposing faces of adjacent knife block members are in flush abutting relationship when said staffs are in said operative positions upon said rib members.

* * * * *